US008333621B2

(12) United States Patent
Chen et al.

(10) Patent No.: US 8,333,621 B2
(45) Date of Patent: Dec. 18, 2012

(54) ELECTRICAL CONNECTOR

(75) Inventors: To-Ying Chen, New Taipei (TW); Yung-Chang Cheng, New Taipei (TW); Min-Han Lin, New Taipei (TW); Kai-Li Wang, New Taipei (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 126 days.

(21) Appl. No.: 13/006,411

(22) Filed: Jan. 13, 2011

(65) Prior Publication Data

US 2011/0256778 A1 Oct. 20, 2011

(30) Foreign Application Priority Data

May 16, 2010 (TW) ..... 099206917

(51) Int. Cl.
*H01R 13/432* (2006.01)

(52) U.S. Cl. ..... 439/746

(58) Field of Classification Search ..... 439/668, 439/682, 857, 850, 746, 843, 845
See application file for complete search history.

(56) References Cited

U.S. PATENT DOCUMENTS

| | | | | |
|---|---|---|---|---|
| 5,863,225 | A * | 1/1999 | Liebich et al. | 439/845 |
| 7,070,465 | B2 * | 7/2006 | Masaki et al. | 439/850 |
| 7,112,102 | B2 * | 9/2006 | Masaki et al. | 439/682 |
| 7,118,424 | B2 | 10/2006 | Masaki et al. | |
| 8,092,236 | B2 * | 1/2012 | Yang et al. | 439/83 |

* cited by examiner

*Primary Examiner* — Edwin A. Leon
(74) *Attorney, Agent, or Firm* — Wei Te Chung; Ming Chieh Chang

(57) ABSTRACT

A electrical connector (100) includes an insulative housing (20) defining a plurality of contact slots (23) extending along a longitudinal direction, a plurality of cantilevered arms (24) extending into the contact slots, respectively, and a transversal groove (25) located in front of the cantilevered arms and communicating with the contact slots; a plurality of contacts (30) received in the contact slots, respectively, each contact having a retention portion (31), a mating portion (32) extending forwardly from the retention portion, a tail portion (33) extending backwardly from the retention portion and a connecting portion (35) connected to the mating portion, and a positioning portion (34, 34') integrally formed with the retention portion and extending into the transversal groove.

20 Claims, 9 Drawing Sheets

ELECTRICAL CONNECTOR

BACKGROUND OF THE INVENTION

1. Field of the Invention

The present invention relates to an electrical connector, especially to an electrical connector with improved contact positioning means.

2. Description of Related Art

U.S. Pat. No. 7,118,424 issued on Oct. 10, 2006 to Masaki et al. discloses an electrical connector for terminated to a cable and mating with a complementary connector mounted onto a substrate. The electrical connector includes an insulative housing with a plurality of contacts received in the insulative housing. The insulative housing defines a plurality of contact slots. The contact has a retention portion accommodated in the corresponding contact slot, a mating portion extending forwardly from the retention portion and a tail portion extending backwardly from the retention portion. In addition, there is a tiny barb formed on a bottom side of the retention portion for engaging with the insulative housing. However, the contact can not endure a big inserting force, as there the tiny barb can not be reliably engaged with the insulative housing, sometimes.

Hence, an improved electrical connector is required to overcome the problems of the prior art.

SUMMARY OF THE INVENTION

An object of the present invention is to provide an electrical connector capable of reliably mating with a complementary connector.

Accordingly, to achieve above-mentioned object, an electrical connector comprises an insulative housing defining a plurality of contact slots extending along a longitudinal direction, a plurality of cantilevered arms extending into the contact slots, respectively, and a transversal groove located in front of the cantilevered arms and communicating with the contact slots; a plurality of contacts received in the contact slots, respectively, each contact having a retention portion, a mating portion extending forwardly from the retention portion, a tail portion extending backwardly from the retention portion and a connecting portion connected to the mating portion, and a positioning portion integrally formed with the retention portion and extending into the transversal groove.

The detailed features of the present invention will be apparent in the detailed description with appropriate reference to the accompanying drawings.

DETAILED DESCRIPTION OF THE INVENTION

Reference will now be made in detail to the preferred embodiment of the present invention.

Figure 1:
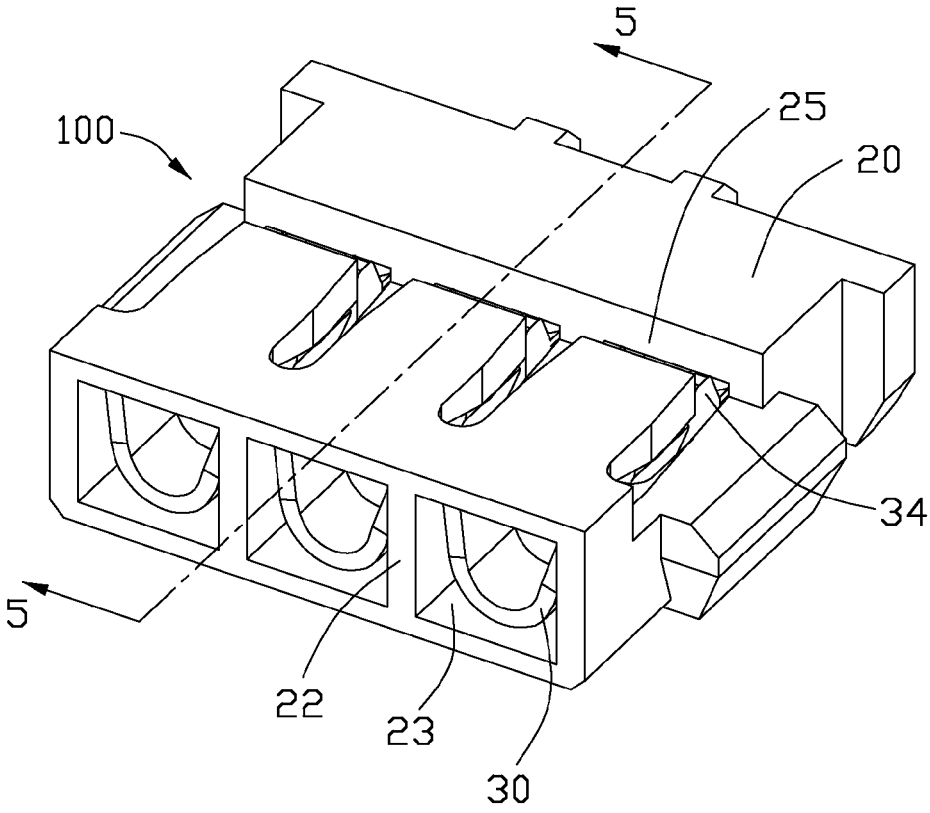
FIG. 1 is an assembled, perspective view of an electrical connector of a first embodiment in accordance with the present invention.
Figure 2:
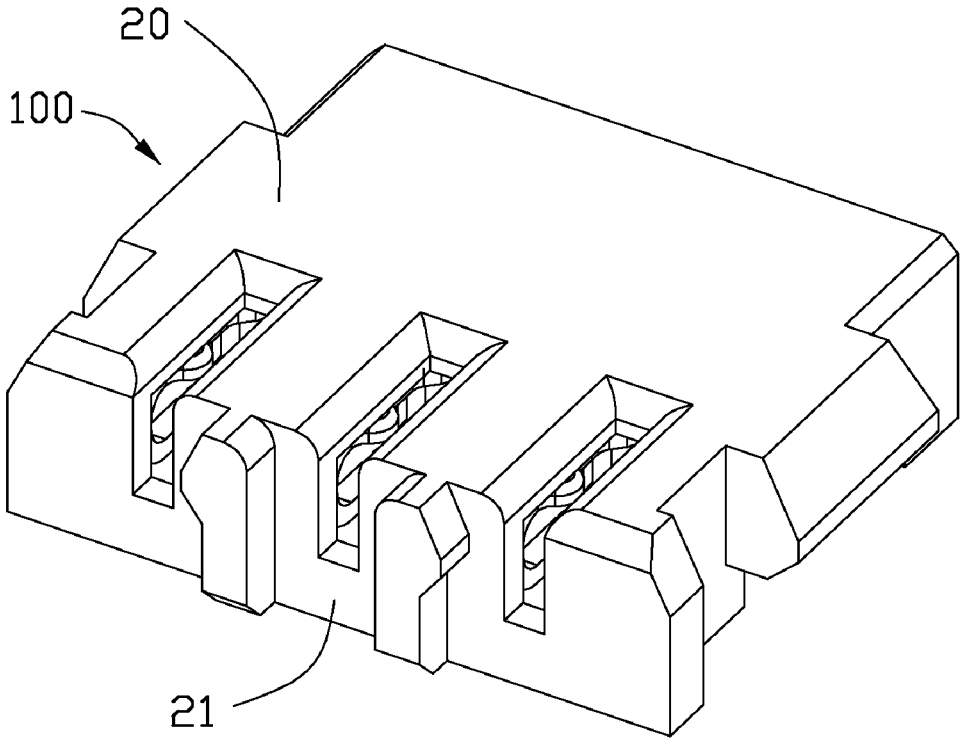
FIG. 2 is similar to FIG. 1, but viewed from other aspect.

Referring to FIGS. 1-2, an electrical connector 100 of a first embodiment in accordance with the present invention comprises an insulative housing 20 and a plurality of contacts 30 mounted to the insulative housing 20.

Figure 3:
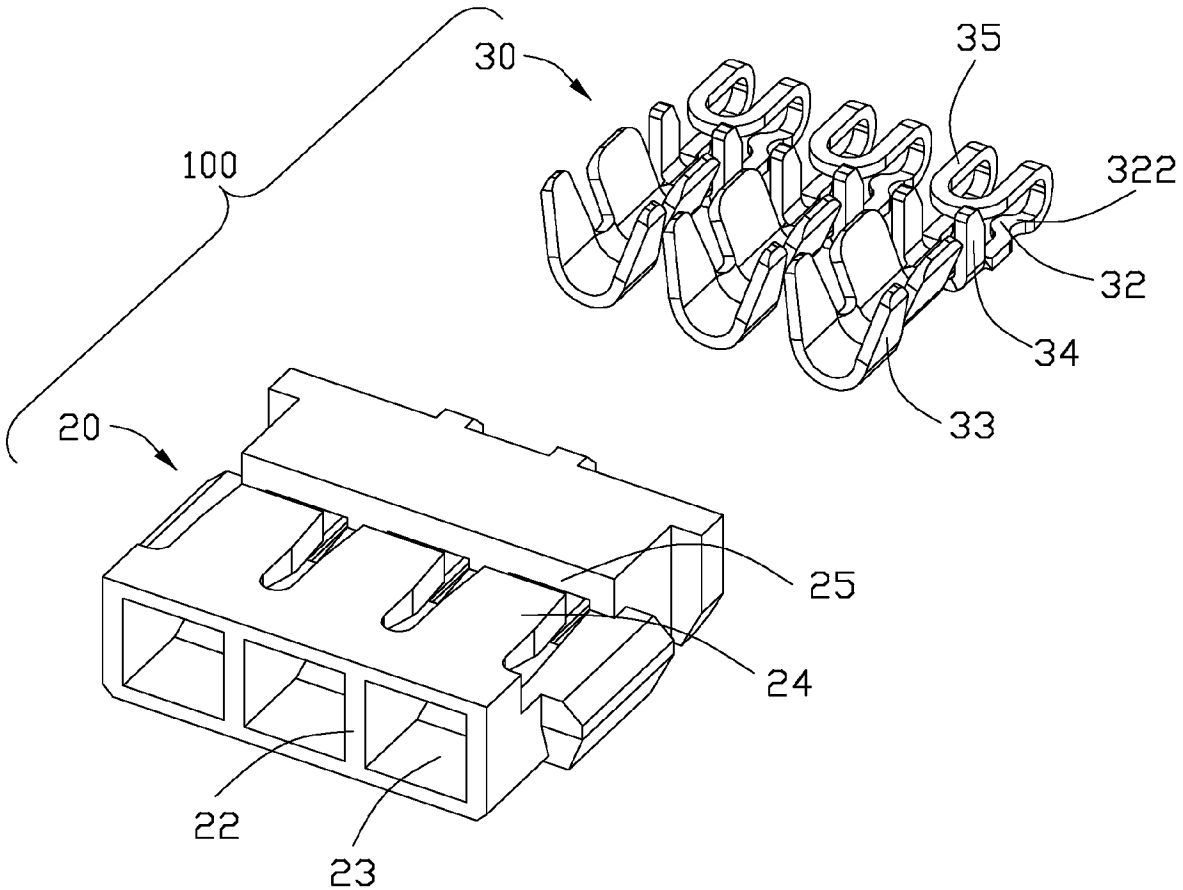
FIG. 3 is an exploded, perspective view of the electrical connector shown in FIG. 1.
Figure 4:
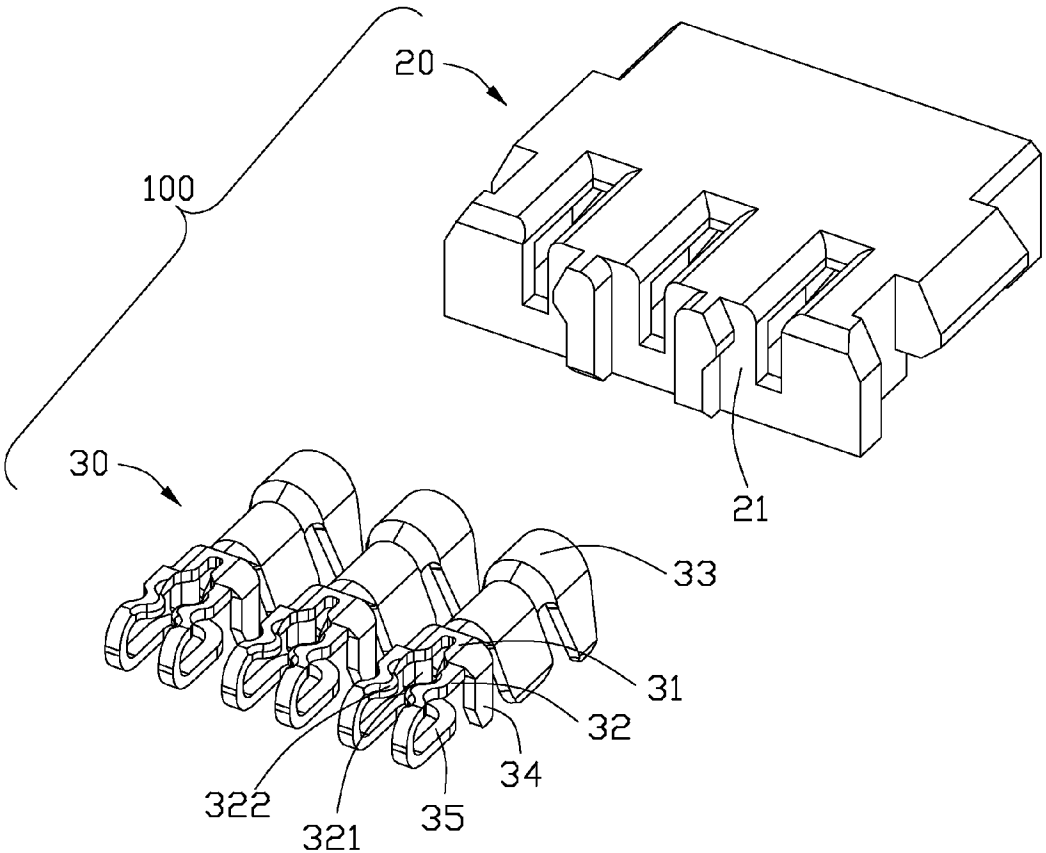
FIG. 4 is a view similar to FIG. 3, but viewed from other direction.

Referring to FIGS. 3-4, the insulative housing 20 includes a front wall 21 and a back wall 22 opposite to the front wall 21. The insulative housing 20 defines a plurality of contact slots 23 extending along a longitudinal direction/a front-to-back direction and through the front wall 21 and the back wall 22. There is a plurality of cantilevered arms 24 formed with the back wall 22 extending into the contact slots 23, respectively. There is a transversal groove 25 located in front of the cantilevered arms 24 and communicates with contact slots 23. However, the transversal groove 25 may a blind groove and not communicate with an exterior in alternative embodiment. There is an inclined guiding side 241 defined on a bottom side of the cantilevered arm 24.

Each of the contacts 30 is a one-piece type structure and has a retention portion 31 accommodated in a corresponding contact slot 23, a mating portion 32 extending forwardly from the retention portion 31 and a tail portion 33 extending backwardly from the retention portion 31. In addition, there is a positioning portion 34 formed on the retention portion 31, projecting upwardly and extending into the transversal groove 25. There is a longitudinal opening 321 defined in the mating portion 32 to separated the mating portion 32 into two branches (not numbered). Each of the branches is inwardly deformed to form a protrusion 322 toward the opening 321. A U-shaped connecting portion 35 is bent downwardly from ends of the mating portion 32 and further extends rearwardly. Understandably, the connecting portion 35 and the mating portion 32 may cooperate with each other to form a so-called mating section for receiving a thicker mating pin of the complementary connector. The positioning portion 34, the connecting portion 35 are disposed adjacent to cantilevered arm 24.

Figure 5:
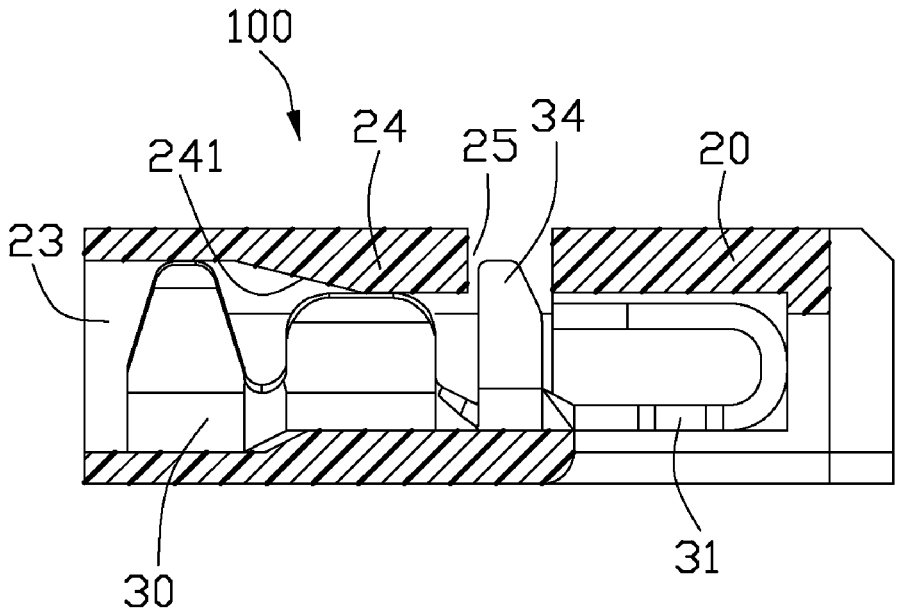
FIG. 5 is a cross-section view of FIG. 1 taken along line 5-5.
Figure 6:
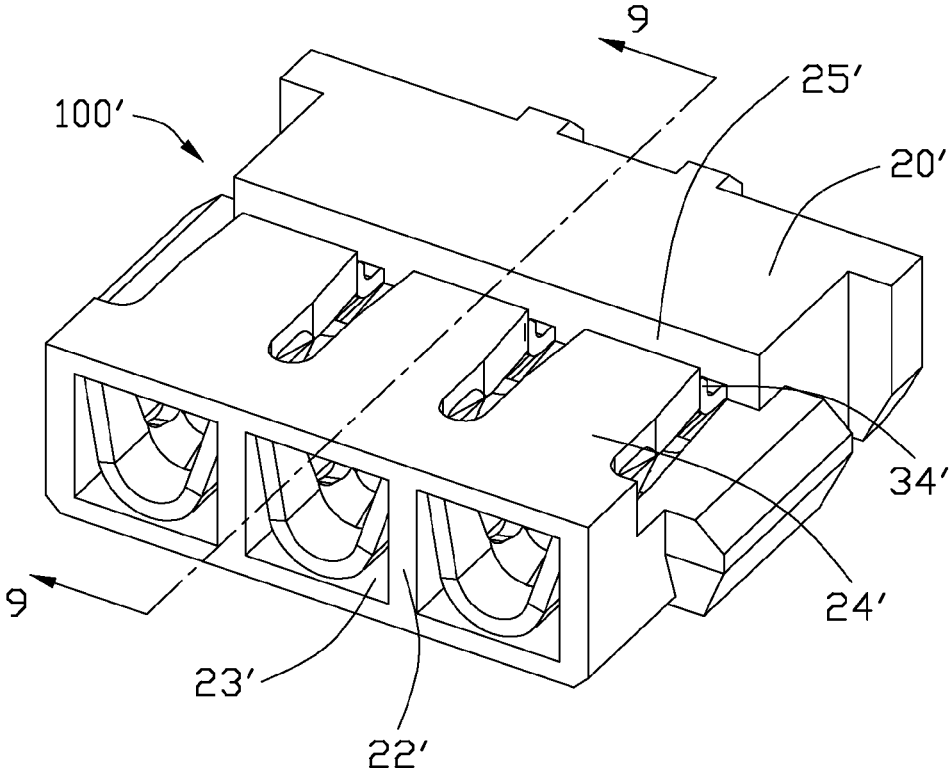
FIG. 6 is an assembled, perspective view of an electrical connector of a second embodiment in accordance with the present invention.

Referring to FIGS. 1 and 5, when assembling, the contacts 30 is assembled to the insulative housing 20 along the front-to-back direction, with the position portion 34 abutting against and sliding along the corresponding guiding side 241 of the cantilevered arm 24 and entering the transversal groove 25, the retention portion 31 of the contact 3 is located at a bottom section of the contact slot 23 and spaced apart from the transversal groove 25 by a substantial distance of the contact slot 23, the positioning portion 34 engaged with the transversal groove 25 and the U-shaped connecting portion 35 constrained in a front portion of the corresponding contact slots 23. Therefore, the contacts 30 can endure a big inserting force.

Referring to FIGS. 6-9, an electrical connector 100' of a second embodiment in accordance with the present invention is introduced. The electrical connector 100' includes an insulative housing 20' and a plurality of contacts 30' received in the insulative housing 20'. The insulative housing 20' of the electrical connector 100' is similar to the insulative housing 20 of the electrical connector 100, and detailed description is omitted hereby.

Figure 7:
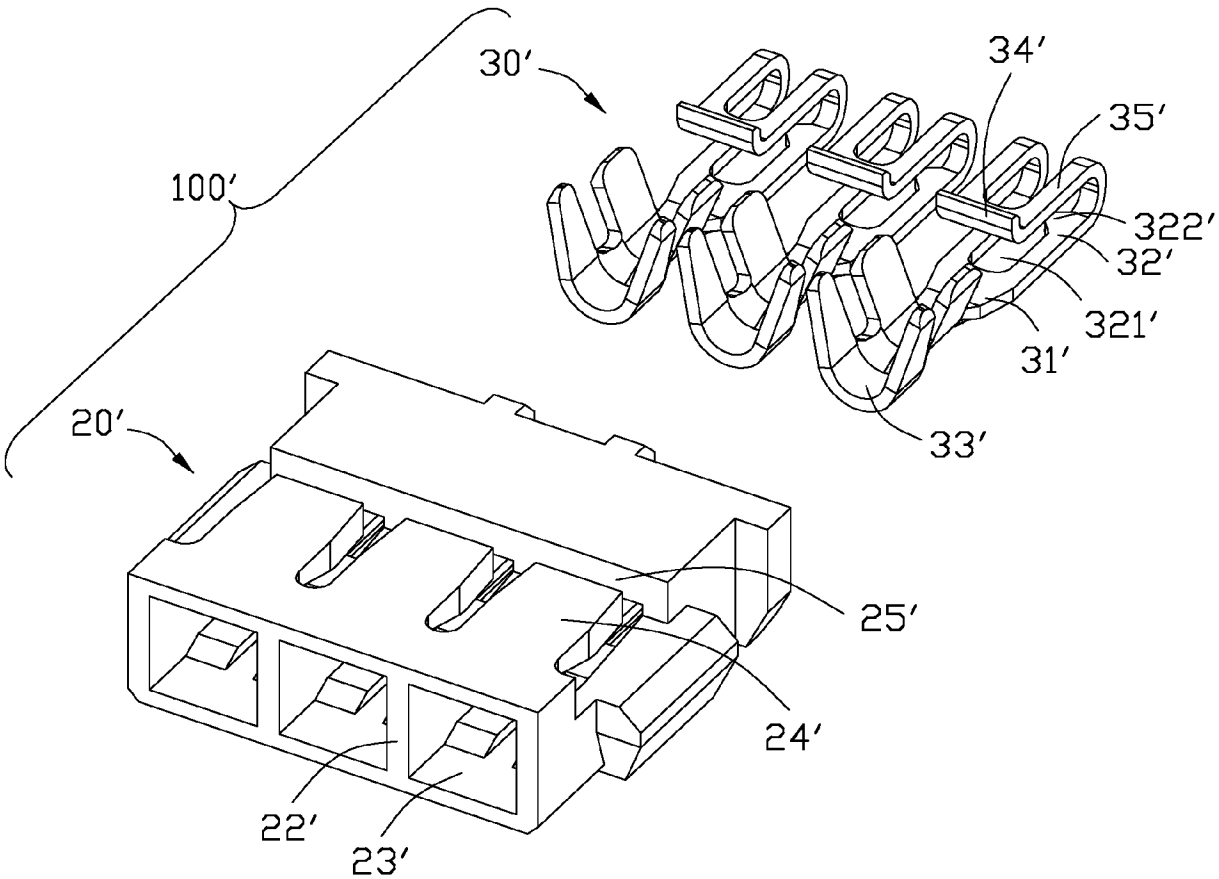
FIG. 7 is an exploded, perspective view of FIG. 6.
Figure 8:
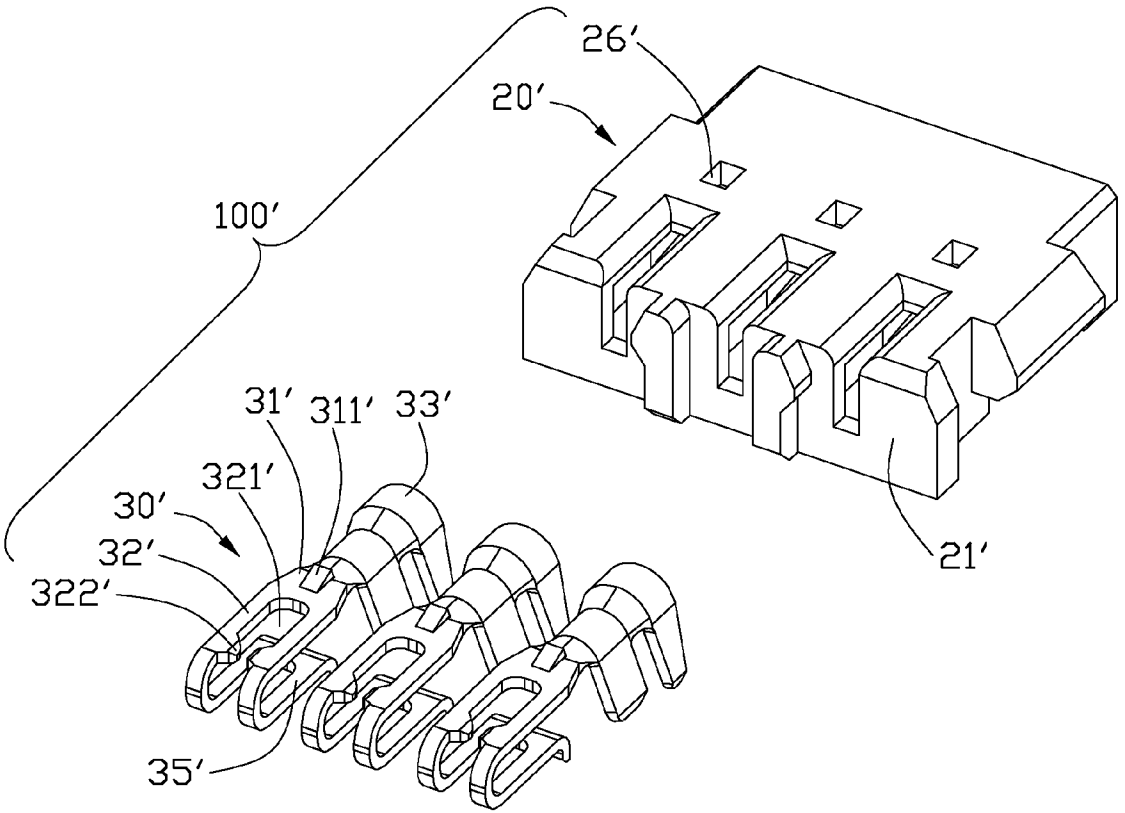
FIG. 8 is a view similar to FIG. 7, but viewed from another direction.
Figure 9:
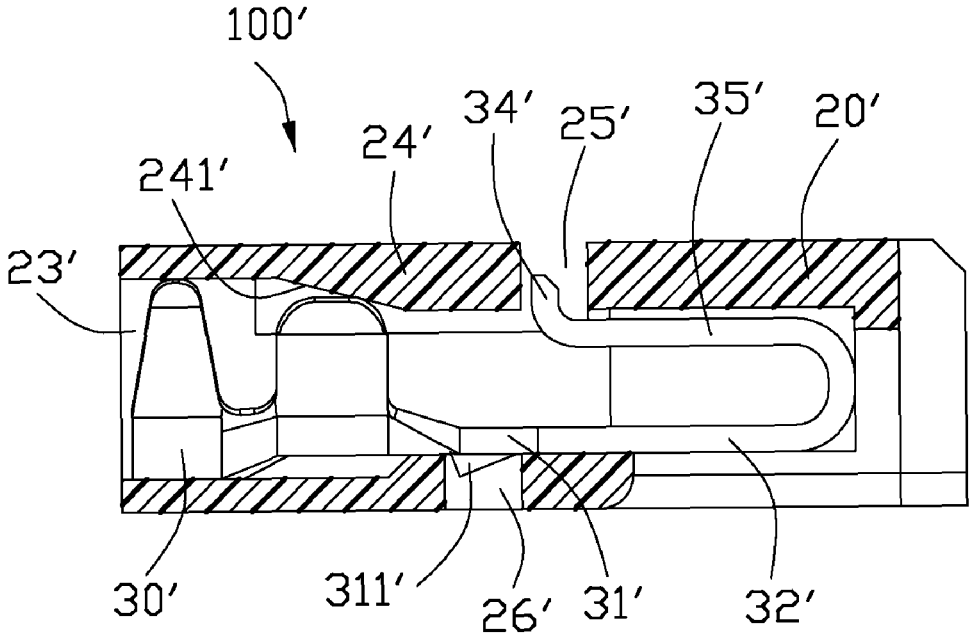
FIG. 9 is a cross-section view of FIG. 6 taken along line 9-9.

Referring to FIGS. 7-8, each of the contacts 30' has retention portion 31' accommodated in a corresponding contact slot 23', a mating portion 32' extending forwardly from the retention portion 31' and a tail portion 33' extending backwardly from the retention portion 31'. In addition, there is a U-shaped connecting portion 35' is bent downwardly from the mating portion 32' and further extends rearwardly. A positioning portion 34' is formed on the U-shaped connecting portion 35' and extends into a transversal groove 25'. The position portion 34' is a transversal flange bending upwardly from an end of the connecting portion 35'. The positioning portion 34' is spaced apart from the retention portion 31' along a vertical direction perpendicular to the longitudinal direction. There is an opening 321' defined in the mating portion 32' and extending along the front-to-back direction. Two protrusions 322' are formed on the mating portion 32' and disposed in opposite sides of the opening 321'. Also, there is a barb 311' formed at a bottom side of the retention portion 31' and engaged with a corresponding cavity 26' defined in insulative housing 20'. The barb 311' offsets from the positioning portion 34' along the vertical direction. As the position portion 34' is formed on the free end 35' and facilitating manufacturing process.

What is claimed is:

1. An electrical connector, comprising:

an insulative housing defining a plurality of contact slots extending along a longitudinal direction, a plurality of cantilevered arms extending into the contact slots, respectively, and a transversal groove located in front of the cantilevered arms and communicating with the contact slots;

a plurality of contacts received in the contact slots, respectively, each contact having a retention portion, a mating portion extending forwardly from the retention portion, a tail portion extending backwardly from the retention portion and a connecting portion connected to the mating portion, and a positioning portion integrally formed with the retention portion and extending into the transversal groove.

2. The electrical connector as claimed in claim 1, wherein the retention portion of the contact is located at a bottom section of the contact slot and spaced apart from the transversal groove.

3. The electrical connector as claimed in claim 1, wherein the connecting portion extends downwardly and backwardly from the mating portion.

4. The electrical connector as claimed in claim 3, wherein the connecting portion is a U-shaped configuration.

5. The electrical connector as claimed in claim 3, wherein the positioning portion is formed on the connecting portion.

6. The electrical connector as claimed in claim 5, wherein the positioning portion is a transversal bar projecting upwardly from an end of the connecting portion.

7. The electrical connector as claimed in claim 4, wherein there is a barb formed on the retention portion and engaged with the insulative housing.

8. The electrical connector as claimed in claim 2, wherein the positioning portion is formed on the retention portion and extends into the transversal groove.

9. The electrical connector as claimed in claim 1, wherein each cantilevered arm has an inclined guiding side defined on a bottom side thereof.

10. The electrical connector as claimed in claim 1, wherein the mating portion of the contact defines a longitudinal opening to divide the mating portion into two branches.

11. The electrical connector as claimed in claim 10, wherein there is a protrusion formed on each branch and toward the longitudinal opening.

12. An electrical connector, comprising:

an insulative housing defining at least one contact slot extending along a longitudinal direction and a slot defined in the housing and communicating with the contact slot and an exterior;

a corresponding contact received in the contact slot, said contact having a retention portion, a mating portion extending forwardly from the retention portion, a tail portion extending backwardly from the retention portion and a connecting portion connected to the mating portion, and a positioning portion formed with the connecting portion and engaged with the slot so as to secure the contact in the contact slot.

13. The electrical connector as claimed in claim 12, wherein the positioning portion is spaced apart from the retention portion along a vertical direction perpendicular to the longitudinal direction.

14. The electrical connector as claimed in claim 13, wherein there is a barb formed on the retention portion and engaged with the insulative housing.

15. The electrical connector as claimed in claim 14, wherein the barb offsets from the positioning portion along the vertical direction.

16. An electrical connector comprising:

an insulative housing defining a plurality of passageways extending therethrough in a front-to-back direction;

a plurality of contacts disposed in the corresponding passageways, respectively, each of said contacts unitarily defining a rear crimping section located in a rear portion of the corresponding passageway for securing to a corresponding wires and a front mating section located in a front portion of the corresponding passageway, the front mating section defines a U-shaped configuration in a side view with a first arm adjacent to the rear crimping section and a second arm relative farther from the rear crimping section and a bight connected between the first arm and the second arm along a longitudinal extension direction of said U-shaped configuration, and a slot extending along said longitudinal extension direction and through the front mating section in thereof a thickness direction perpendicular to said longitudinal extension direction so as to form two spaced strips in a transverse direction perpendicular to both said longitudinal direction and said thickness direction under condition that free ends of said two spaced strips on the second arm are joined together; wherein the joined free ends further extend into a recess of the housing for restraint consideration so as to prevent improper deformation of the mating section during mating.

17. The electrical connector as claimed in claim 16, wherein said two spaced strips respectively form a pair of inward protrusions for sandwiching a mating pin of a complementary connector.

18. The electrical connector as claimed in claim 17, wherein said pair of inward protrusions are formed on the first arm.

19. The electrical connector as claimed in claim 18, wherein said contact further includes a retention structure between the first arm and the crimping section for retaining the whole contact in the corresponding passageway.

20. The electrical connector as claimed in claim 16, wherein the recess extends through the housing to communicate with an exterior in a direction perpendicular to the front-to-back direction, and the joined ends extends into said recess and is further exposed to the exterior in said direction for inspection to assure a proper assembling between the contact and the housing.

* * * * *